United States Patent [19]

Franek et al.

[11] Patent Number: 4,626,157

[45] Date of Patent: Dec. 2, 1986

[54] METHODS OF MAKING CONTAINERS

[75] Inventors: Josef T. Franek, Chorleywood; Paul Porucznik, Kennington; Peter H. Serby, Newbury; Christopher J. N. Tod, Steyning, all of United Kingdom

[73] Assignee: Metal Box Public Limited Company, United Kingdom

[21] Appl. No.: 551,205

[22] Filed: Nov. 14, 1983

Related U.S. Application Data

[63] Continuation-in-part of Ser. No. 293,634, Aug. 10, 1981, Pat. No. 4,423,823.

[30] Foreign Application Priority Data

Dec. 8, 1979 [GB] United Kingdom ..... 7942425

[51] Int. Cl.[4] ..... B21D 51/26

[52] U.S. Cl. ..... 413/1; 413/4; 413/6; 413/69

[58] Field of Search ..... 413/1, 4, 6, 69; 156/69, 203, 218, 293, 466; 220/75, 77, 80

[56] References Cited

U.S. PATENT DOCUMENTS

| | | | |
|---|---|---|---|
| 2,122,537 | 2/1938 | Pfeffer | 413/18 |
| 3,263,636 | 8/1966 | Smith | 413/6 |
| 3,295,485 | 7/1967 | Gedde | 413/7 |
| 3,832,963 | 9/1974 | Gayner | 413/18 |
| 3,868,919 | 3/1975 | Schrecker | 413/18 |
| 4,037,550 | 7/1977 | Zofko | 413/6 |
| 4,045,860 | 9/1977 | Winckler | 413/4 |
| 4,363,582 | 12/1982 | Bloeck | 413/18 |

*Primary Examiner*—Leon Gilden

*Attorney, Agent, or Firm*—Diller, Ramik & Wight

[57] ABSTRACT

In a metal can at least one component having an edge portion forming part of a seam is made from pre-laminated plate comprising a metal substrate with a polymeric film bonded over the whole of one or both of its sides. An aerosol valve cup is made from such plate with its underside having such a polymeric layer, and is secured to the can body in a seam by conventional mechanical deformation, such as swaging, so as to compress the polymeric layer in the seam. This provides a satisfactory seal without the need for any additional sealing material within the seam.

1 Claim, 14 Drawing Figures

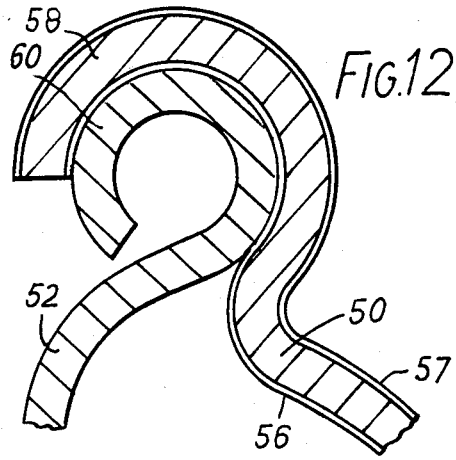
FIG.12
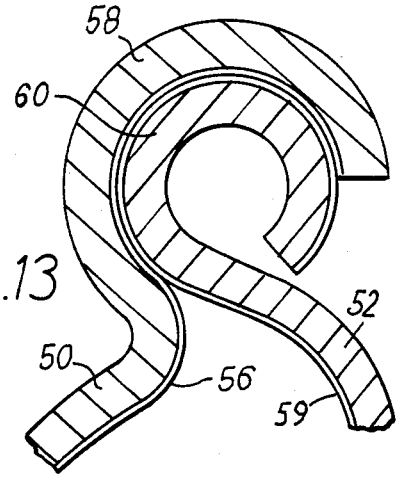
FIG.13
FIG.14
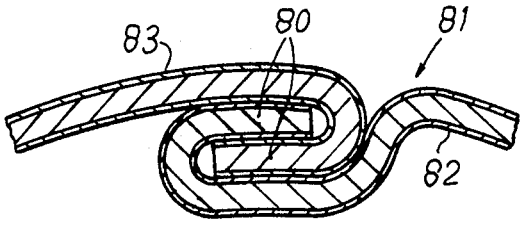

METHODS OF MAKING CONTAINERS

This is a continuation-in-part of United States Application Ser. No. 293634 filed Aug. 10, 1981 now U.S. Pat. No. 4,423,823.

TECHNICAL FIELD

This invention relates to methods of making containers of the kind having a plurality of components at least one of which is of laminar metallic material, the method including the forming of at least one seam securing an edge portion of a said laminar metallic component to an overlapping edge portion of a component of the container. Such a container will be called herein "a container of the kind specified". Examples of such seams are the double seam by which a metal can end member is seamed to a metal can body; the swaged seam whereby the valve cup of an aerosol dispensing container (hereinafter referred to as an aerosol can) is seamed to the body of the container; and a longitudinal side seam of a built-up metal can body.

BACKGROUND ART

One example of a container of the kind specified is a can of the so-called "open-top" kind, i.e. a can comprising a can body which by itself has an open top end, but which has this end closed by a can end member secured to the can body by means of a peripheral double end seam, and which may also be of the kind including a can body cylinder having a longitudinal side seam. Another example is an aerosol can comprising a can body, which may be formed in one piece, or which may comprise a can body cylinder closed at its bottom end by an end member and at its top end by a domed cover member. The one-piece aerosol can body, or the domed cover member, has a mouth which is itself closed by a valve cup, carrying the aerosol dispensing valve. The valve cup is usually swaged on to the body.

As far as open-top cans are concerned, it has for many years been conventional practice to stamp a can end member from a sheet of metal which has been pre-lacquered for subsequent protection of the metal, or of the eventual contents of the can, or both, and to apply a suitable sealing compound to a peripheral flange of the can end member. Following this, the end member is positioned over an open end of the sheet metal can body, which is also pre-lacquered, with the peripheral flange of the end member overlying a peripheral flange of the body. The two flanges are then deformed together to produce a double seam.

This process has a number of disadvantages. Firstly, during the seaming operation there is a danger that the lacquer may be damaged on either the can end member or the can body as a result of local high pressure between the end member and the body, or friction between one of these parts and the seaming tools. If the lacquer is damaged there follows a risk of corrosion of the metal and of contamination of the contents of the can. Another problem is that the sealing compound is occasionally squeezed out during formation of the double seam and this again may have a detrimental effect on the quality of the seal provided by the seam and on the eventual contents of the can.

Reverting to aerosol cans, the same problems may also occur when the cover member is joined to the can body cylinder. Both of these parts may be lacquered prior to being joined together, and, as in the case of an open top can end member, a peripheral flange of the aerosol can cover member is lined with a suitable sealing compound. In this case, if the lacquer on an internal surface is damaged whilst the cover member is being secured to the can body, there is a considerable risk of internal rusting if the aerosol formulation to be contained by the can includes water. Additionally, if sealing compound is squeezed into the interior of the can body whilst the cover member is being secured to the latter, and particles of the compound become dislodged, they may eventually, in use, block the aerosol dispensing valve.

Similar problems may occur when the cup is swaged on to the cover member. The cup has a peripheral flange or cup curl, and between the cup curl and the body curl with which it forms a seam, there is interposed a sealing gasket. This gasket takes one of two forms, viz. a separate, thin washer-like member, or a layer of a sealing compound, applied to the underside of the cup curl in liquid form and then cured to a resilient, solid condition.

The sealing compound is typically of a suitable latex preparation, typically applied as a water-based suspension in sufficient quantities to give a final dry weight of 570 mg., corresponding to a dry thickness which at the thickest cross-section of the gasket is in the approximate range 0.50 to 0.65 mm. Apart from the problem, mentioned above, of pieces of the gasket possibly breaking off and falling into the contents of the container, this relatively great thickness of gasket material (lining compound) has another disadvantage. Although it is technically feasible to allow the wet latex suspension to dry naturally at ambient temperature, the storage time involved would be economically unacceptable. It is therefore necessary to accelerate drying, and to this end the provision of ovens is required. This, although cheaper than natural drying, is still very costly in terms of capital cost, maintenance cost, energy consumption and space requirements. Similar gaskets are commonly applied to the inside surface of one of the overlapping edge portions of an open-top can side or end seam.

There has for some time, unconnected with the problems discussed above, been considerable interest in laminated materials. These are being developed primarily to give them resistance to the temperatures employed in the "processing" (e.g. pasteurising) of foodstuffs or beverages packed in cans, as an alternative to the use of a tin coating, since this coating is becoming more and more expensive. The laminates concerned comprise a thin polymeric layer overlaid upon a metallic substrate. The base material used for such laminating may be for example "tin-free steel", blackplate, or aluminium. Out of many possible polymer films tested, polypropylene is one which appears promising for the packaging industry, due to its low cost, fusibility (faces can be heat sealed to each other), low extractability and ability to withstand processing temperatures. The back of the film may be printed prior to lamination, thus protecting the printing inks. Also, boxes such as biscuit boxes and the like may be completed by heat fusing at the joints after being folded.

Such laminates are quite well documented in the prior art, for the purposes mainly of providing a temporary surface having a low friction in order to facilitate working of the metal, or of rendering a tin coating on tinplate unnecessary having regard to the increasing cost of metallic tin.

Many proposals have been published in the patent literature for seams, for metal cans and other containers, in which the overlapping edge portions are bonded together. Sometimes the proposal is that this be achieved by means of an interposed adhesive compound; in other publications it has been proposed to apply polymeric layers, by way of local lamination, to the mating surfaces of the seam. In all of these proposals the use of heat is necessary to cure the adhesive compound or to cause the local polymeric surfaces to become fused together within the seam. In all of these cases the seam appears to present an effective seal by virtue of its two parts being bonded together. One proposal which is a variation on the above, relates to an aerosol can of the rather specialised kind in which the product to be dispensed is contained in a plastics bag or membrane within the can, to separate the product from the customary propellant. In that proposal the top edge of the bag is trapped within the valve cup seam, i.e. between the peripheral terminal curls or flanges of the valve cup and can body. However, in order to produce an effective seal within the seam, heat must be applied after the seam has been formed, in order to soften the plastics material within it.

THE INVENTION

This invention proposes a method of making any container of the kind specified, in which effective sealing is obtainable without the need for sealing gaskets, but in which at the same time recourse to bonding of the seam, and the use of heat, are also unnecessary.

Comprised within the scope of the invention is a container, or a component intended for such container, when the container is made by a method according to the invention.

According to the invention in a first aspect, a method of making a container comprising a plurality of components includes the steps of:

(i) making at least a first laminated component for the container from pre-laminated sheet comprising a metal substrate layer having a layer of polymeric material bonded over the whole of at least one side of the substrate layer; and (ii) locating a first edge portion, being part of said first laminated component, in overlapping relation with a second edge portion, being part of a said laminated component or of an unlaminated metal component, so that said polymeric material of the first edge portion is facing the second edge portion; said method comprising the further step of:

(iii) urging the edge portions by mechanical deformation into the form of a seam, whilst compressing the said polymeric material to form a seal, steps (ii) and (iii) being performed without any sealing material (other than said polymeric material present by virtue of step (i)) being or having been introduced, and without any bonding between the edge portions.

The invention is especially, though certainly not exclusively, concerned with the valve cup seam of an aerosol can, and provides for the crimping or swaging of a valve cup made from laminated material, directly on to the can body in such a way as to compress the polymeric material of the laminate to create a seal without the use of separately applied sealing materials.

By virtue of its resilience and bond with the underlying metal, the polymeric material provides a firm seal at the join between the two parts and, even when squeezed, exhibits negligible tendency for particles thereof to become dislodged into the container. This is an improvement over a conventional sealing gasket, the latter being omitted entirely.

Apart from the valve cup seam mentioned above, another possible application of the invention is to an open-top can or an aerosol can, where seams formed using the polymeric layer may comprise interlocked double seams whereby one or two can end members are secured to the can body, or a longitudinal side seam of the can body.

The containers made according to the invention can have their components, and then seams made on conventional and existing equipment without the need for any additional apparatus, or modifications to the equipment, such as are required where, for example, heating is needed to cure an adhesive compound or to otherwise effect bonding of the seam. In addition, provision of a separate sealing compound, or separate gasket member, is unnecessary.

Whilst no deliberate bonding of one of the overlapping portions of the seam to the other is necessary, it is to be understood that the invention does not exclude the case where each of the overlapping portions has a portion of a polymeric layer (so that these polymeric portions closely engage each other within the seam), and where the mechanical forces imposed during or after formation of the seam are such that some spontaneous welding occurs between the polymeric portions.

The polymeric layer may be of any one of a number of polymeric materials, including polyesters and polypropylene. Polypropylene provides a good barrier against the passage of water and resists attack by acids, oils and greases; it is thus capable of withstanding the environment present both internally and externally of food cans, beverage cans, aerosols and many other containers. As a result, in containers for most products, the surface or surfaces covered by a polypropylene layer need not be pre-lacquered. Thus, at least two of the manufacturing operations normally required in the production of the aerosol container, viz. (a) the application of a sealing gasket in any form, and (b) the pre-lacquering of at least one of the surfaces to be joined, may be omitted with resultant saving in cost. Furthermore, polypropylene and many other polymer films, being resilient, unlike conventional lacquers, is highly resilient to damage during the deformation of the two parts which takes place whilst they are being joined together.

Embodiments of the invention will now be described, by way of example only, with reference to the accompanying diagrammatic drawings briefly described below.

BRIEF DESCRIPTION OF THE DRAWINGS

FIGS. 12 and 13 are fragmentary sections through the seam joining the valve cup and cover member of two embodiments of aerosol can produced by the operation illustrated in FIGS. 9 to 11; and FIG. 14 is a cross-section through a longitudinal side seam of a can body illustrating a further embodiment of the invention.

BEST MODE OF CARRYING OUT THE INVENTION

Figure 1:
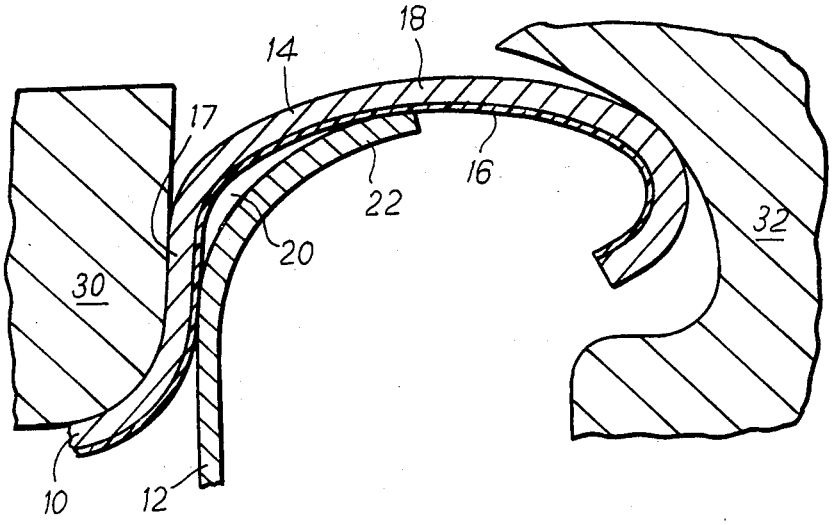
FIGS. 1 to 4 illustrate four stages in the operation of securing a can end member to a can body by means of a double seam, during manufacture of a can embodying the invention.

FIG. 1 shows a fragment of a can end member 10 about to be secured to a cylindrical can body 12. The member 10 may be an end member for closing either the top or the bottom of the body 12. The body 12 may be a body for an open-top can or for an aerosol can. In the latter case the member 10 is a cover member, domed or generally cone-shaped, having an aperture (not shown) for securing a valve cup (not shown) thereto. The end member 10 is formed from sheet metal 14 which in this example is the commercially-available material known as tin-free steel. A sheet of cast polypropylene film is adhesively bonded over the whole of one surface of the metal substrate 14, to form a resilient polymeric layer 16. The other surface of the metal is optionally lacquered. The end member 10 has a chuck wall 17 terminating in a peripheral end curl or flange 18. The chuck wall 17 lies within the open end 20 of the can body 12 so that the flange 18 overlies a peripheral flange 22 of the body 12 with the layer 16 in contact with the body flange 22. The body 12 is a conventional sheet metal can body.

Figure 2:
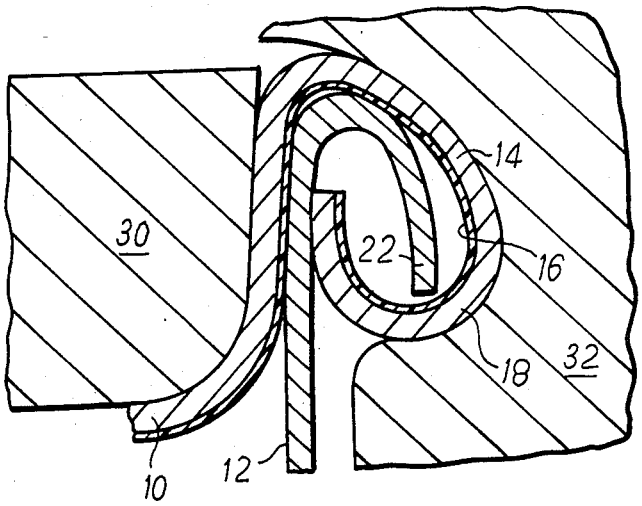
Figure 3:
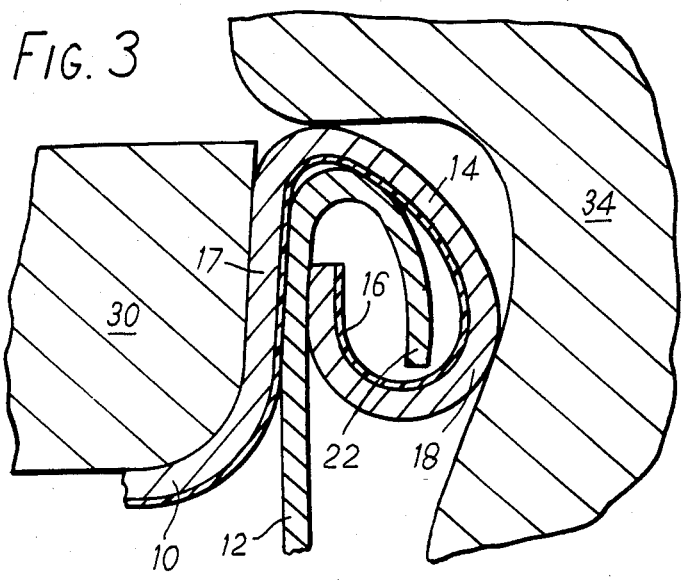

In order to join the end member 10 and the body 12 together, a central, coaxial chuck 30 and an external, first-operation seaming roll 32 are used in an entirely conventional manner. The chuck 30 engages the chuck wall 17 to locate it in position in the body 12, and the roll 32 engages the end flange 18, firstly as shown in FIG. 1 and subsequently as shown in FIG. 2, to curl together the end flange 18 and body flange 22. The roll 32 is then withdrawn and a second-operation seaming roll 34 is advanced into engagement with the end flange 18, as shown in FIGS. 3 and 4, to flatten the partly-formed seam and thus produce the completed double seam illustrated diagrammatically in FIG. 4 and more accurately in FIG. 5.

Figure 4:
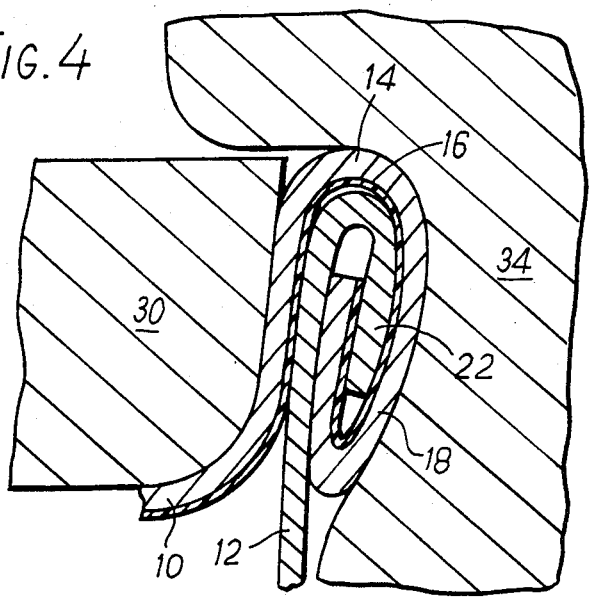
Figure 5:
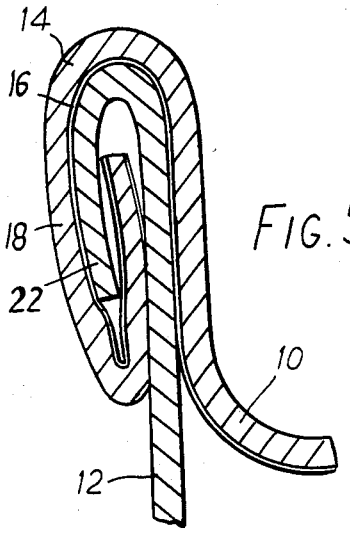
FIG. 5 is a fragmentary section through the double seam produced by the operation illustrated in FIGS. 1 to 4.

It will be evident from FIGS. 4 and 5 that, at the end of the seaming operation, the polymeric layer 16 is compressed between the metal of the end flange 18 and that of the body flange 22, to provide a seal between the end 10 and the body 12 without the addition of any sealing compound or gasket, and without the use of heat. During the seaming operation described above with reference to FIGS. 1 to 4, the substantial forces exerted on the chuck wall 17 and on the flanges 18 and 22 by the seaming tools 30,32,34, give rise to very high hoop stresses and shear stresses at the interfaces between the two components 10 and 12. These stresses are absorbed largely or entirely by the polymeric layer 16, which can survive substantial strain without becoming separated from the metal substrate. At the same time, the yielding layer 16 exerts low friction on the lacquer normally provided on the surface of the body 12 with which it is in contact, so minimising or preventing damage to the lacquer. The maintenance of the mechanical bond between the polymeric layer and the corresponding metal surface minimises or prevents the detachment of pieces of polymer which might fall into the container. Furthermore, the layer 16 protects the underlying metal of the end member 10 during the useful life of the can.

Figure 6:
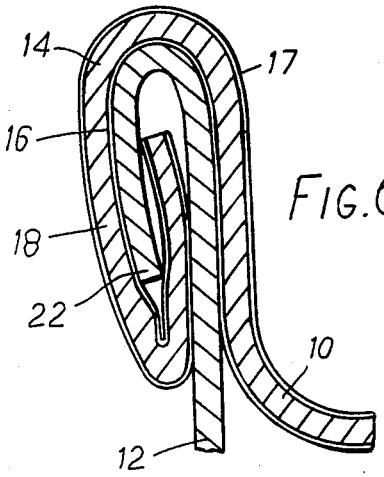
FIGS. 6 to 8 are similar sections to that of FIG. 5, and illustrate three respective modifications.
Figure 7:
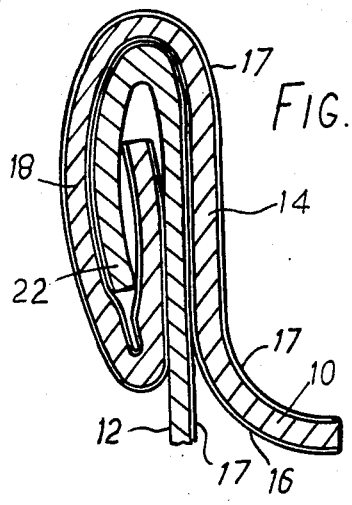
Figure 8:
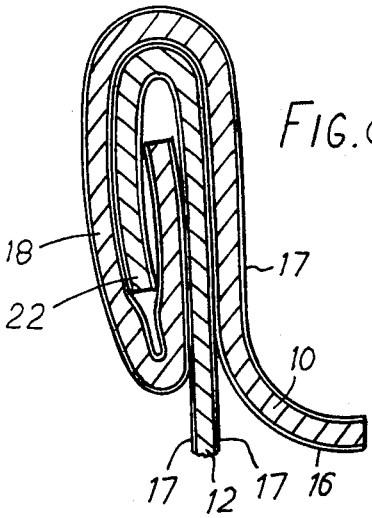

FIGS. 6, 7 and 8 show the double seam of three respective cans similar to the one illustrated in FIG. 5, except that: in FIG. 6, the outer surface of the end member 10; in FIG. 7, the outer surface of the end member 10 and the inner surface of the body 12; and in FIG. 8, the outer surface of the end member 10 and both surfaces of the body 12, have additional resilient polymeric layers 17 bonded to the metal of the respective components 10,12. In each case any metal surface not having a polymeric layer 16 or 17 may be lacquered in conventional manner. In the arrangements shown in FIGS. 7 and 8 where two polymeric layers 16 and 17 are forced into contact with each other, the stresses set up at their mutual interface may tend to cause spontaneous welding together of the two polymeric layers. Other variations are also possible; for example, the interior surface only of the body may be provided with the polymeric layer 17, the end member having no polymeric layer.

Figure 9:
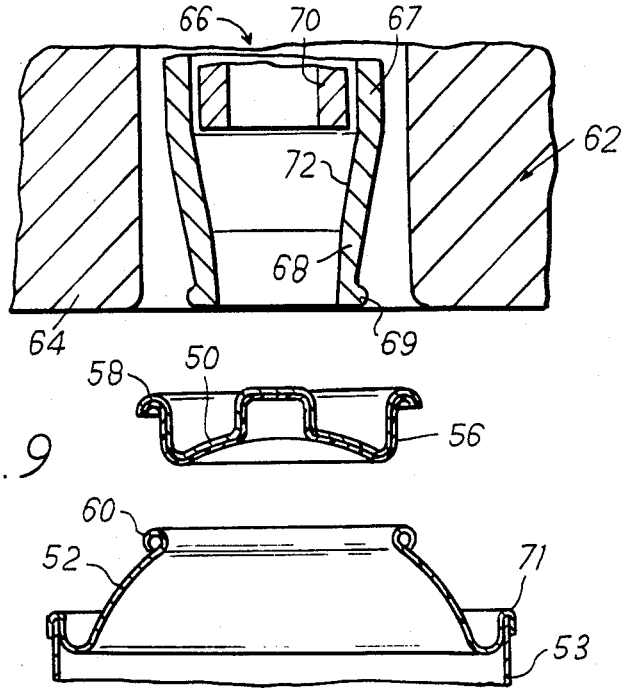
FIGS. 9 to 11 illustrate three successive stages in a swaging operation for joining a valve cup to the can body of an aerosol can embodying the invention, during manufacture of the can.
Figure 10:
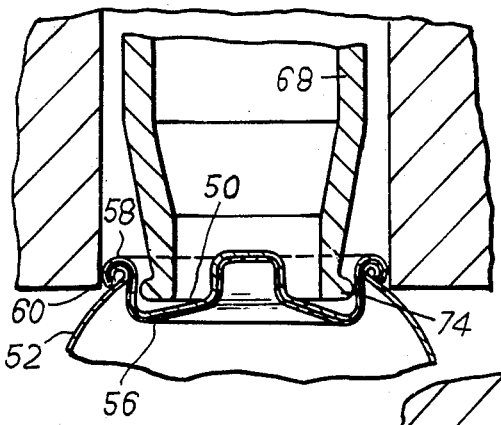
Figure 11:
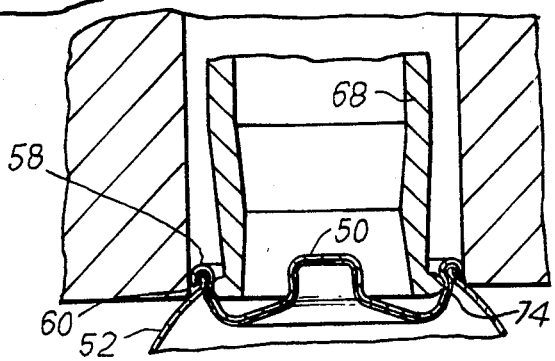

In the process illustrated in FIGS. 9, 10 and 11, a valve cup 50 is swaged to a domed cover member 52 of an aerosol can having a body cylinder 53. The valve cup 50 is formed by a conventional pressing operation (not illustrated) from pre-laminated sheet material comprising an aluminium substrate layer with a sheet of cast polypropylene film adhesively bonded over the whole of one side of the substrate. The valve cup 50 is formed from the sheet with the polypropylene constituting a polymeric layer 56 of the valve cup. The layer 56 is shown of exaggerated thickness. Its actual thickness is approximately 0.2 millimeter.

The cup 50 has a peripheral curl or cup flange 58 whose underneath surface, i.e. part of the exposed surface of the layer 56, is arranged to overlie a curled peripheral body flange 60 which defines the central aperture of the can body (see FIG. 10). Those surfaces of the can body and valve cup that do not have the polymeric layer 56 may be pre-lacquered.

The cup 50 and cover member 52 are secured together by mechanical deformation using a conventional swaging head 62. The head 62 comprises a tool 66 coaxially disposed within a locating ring 64. The latter is arranged to engage around the cup flange 58 and to press it against the body flange 60. The tool 66 comprises a collet 67 having resilient segmented chives or fingers 68, and a mandrel 70 movable axially downwards to urge the fingers 68 radially outwardly by engagement with a sloping shoulder 72 on the back of each finger, and axially upwards to allow them to retract resiliently to their normally position shown in FIG. 9. Each finger 68 has an external cup-engaging portion 69.

In operation, the locating ring 64 is moved into engagement with the cup flange 58, to urge it into close contact with the body flange 60. The collet 67 is then moved downwardly to the position shown in FIG. 10, until the cup-engaging portions 69 are level with the outer wall, 74, of the cup 50 below the cup flange 58. Finally the mandrel 70 is moved downwardly to force the fingers 68 radially outwardly into engagement with the cup wall 74; the cup wall 74 is thus deformed outwardly as shown in FIG. 11 to engage behind the body flange 60 and secure the cup 50 to the cover member 52.

If desired, after the fingers 68 have been radially extended once, they may be retracted to withdraw them from engagement with the cup 50, which is then rotated relative to the fingers 68; the latter are then expanded radially once again, to perform a second swaging operation. This may be repeated again, as many times as may be desired, preferably with rotation of the cup 50 and cover member 52 between each swaging operation and the next. This ensures that the cup wall 74 is deformed outwardly to engage behind the cover flange 60 along its entire circumference rather than merely along a major proportion of its circumference. Multiple swaging (i.e. performing more than one swaging operation as described above) naturally tends to create a better seal, though an adequate seal is possible with a properly-conducted single swaging operation.

As with the open-top can closing operation described with reference to FIGS. 1 to 5, the polymeric layer of the cup flange 58 becomes compressed during the swaging operation, and forms an effective seal between the valve cup 50 and the cover member 52, without any heat being applied, and without any separate or additional sealing material, or any adhesive, being introduced between the cup flange or curl 58 and the body curl 60 at any time. The polymeric layer 56 also protects both the metal of the cup 50 and the lacquer and metal of the cover member 52, both during and after swaging.

Referring now to FIGS. 12 and 13, two respective modifications of the aerosol can shown in FIG. 11 are there illustrated, and may be produced by either single or multiple swaging operations as desired. In FIG. 12, the valve cup 50 is made from metal sheet pre-laminated with adhesively bonded polypropylene film over the whole of both its sides, so that the cup 50 has a polymeric layer 57 over its upper as well as its lower side. In FIG. 13, the cup 50 has a polymeric layer 56 on its underside, whilst the cover member 52 has another polymeric layer 59 on its inside. In each instance the component is made from pre-laminated material. Other variations are, of course, also possible so long as the metal of one of the two components is separated from that of the other in the region of the flanges 58,60 by at least one polymeric layer. In the case illustrated in FIG. 13, it will be noted that if the same thickness (viz. about 0.2 millimeter) is required for the sealing layer of the seam as in FIG. 12, each of the layers 56,59 in FIG. 13 can be approximately 0.1 millimeter thick.

Referring now to FIG. 14, the invention may be applied to the joining together of a pair of edge portions which are substantially flat, such as the edge portions 80 of a can body cylinder 81, which are interlocked to form a double side seam of the body cylinder. The latter is formed, again, from pre-laminated sheet material comprising a metal substrate having a sheet of cast polypropylene film adhesively bonded to it, in this case over the whole of both its sides, so as to form on the inside of the body cylinder 81 a polymeric layer 82, and on its outside a similar layer 83, the latter being optional.

Although in the examples described the metal substrate of the components made from pre-laminated material is "tin-free steel" or aluminium, either tin-plated steel (tinplate) or blackplate may for example be used instead.

The pre-laminated plate (sheet material) from which the aerosol valve cup, can end member, can body or other component is made, is selected according to the requirements of the particular application for which it is intended. For example, in the case of a valve cup for an aerosol can, pre-laminated plate is selected whose metal substrate is of tinplate or other available steel, or aluminium, of a thickness which may be similar to that of conventional unlaminated valve cups of the same metal, and which is sufficient to provide the required mechanical strength in use. Similarly the plate is selected for a suitable thickness, quality and tenacity of the polymeric film layer or layers bonded to the metal substrate. As to the thickness of any such layer, it may be either more or less than 0.2 millimeter, but is unlikely to be less than 0.01 millimeter.

Whilst in the examples above, the polymeric film adhesively bonded to a metal substrate is described as being cast polypropylene, it may comprise any other suitable polymeric material such as a polyolefin or polyester material, and in some cases it may be extruded film instead of cast film. Conventionally, whatever its thickness or other characteristics may be, the polymeric layer is bonded to the metal substrate by use of a suitable adhesive compound between it and the substrate, though the invention is not limited to embodiments where components are made of plate for which this is the case; for example, the polymeric layer may have been adhesively bonded direct to the substrate itself by a process involving use of heat. In another alternative method the polymeric layer is applied to the metal in powder form by electrostatic deposition and subsequently melted in known manner. In each case, however, the (or each) polymeric layer must be firmly bonded to the metal.

The methods described above are not restricted to securing can end members to open-top can bodies or to securing the valve cup of an aerosol can to the cover member. They may for example be used to form the double seam 71 (FIG. 9) securing the cover member 52 to the aerosol can body cylinder 53, in which case either the former or the latter or both will be provided with at least an internal polymeric layer such as the layer 56 or 59 shown in FIG. 13.

We claim:

1. A method of making an aerosol container comprising the steps of (i) providing a tubular container body having an opening set-off by a curl, (ii) providing a laminated component for the container from a pre-laminated sheet comprising a metal substrate layer having a layer of polymeric material bonded over the whole of at least one side of the substrate layer, (iii) forming the laminated component into an aerosol valve cup having a central portion and an annular channel, (iv) positioning the annular channel of the aerosol valve cup upon the curl of the aerosol container with the polymeric material sandwiched therebetween, and (v) urging the annular channel and curl by mechanical deformation into a crimped mechanical connection, while compressing the polymeric material to form an air/gas-tight seal, steps (ii) through (v) being performed without any sealing material (other than said polymeric material) present by virtue of step (ii) being or having been introduced, without adding heat, and without any bonding between the annular channel and curl.

* * * * *